US010606302B2

(12) United States Patent
Stoufer et al.

(10) Patent No.: US 10,606,302 B2
(45) Date of Patent: Mar. 31, 2020

(54) SELF-CENTERING MECHANISM FOR AN APPLIANCE KNOB

(71) Applicant: Electrolux Home Products, Inc., Charlotte, NC (US)

(72) Inventors: Paul Stoufer, Lincolnton, NC (US); Kevin Carpenter, Morrisville, NC (US); Michelle Demers, Morrisville, NC (US); David A. Clemens, Chapel Hill, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 441 days.

(21) Appl. No.: 15/457,625

(22) Filed: Mar. 13, 2017

(65) Prior Publication Data

US 2018/0259996 A1 Sep. 13, 2018

(51) Int. Cl.

| | |
|---|---|
| ***G05G 5/05*** | (2006.01) |
| ***F24C 7/08*** | (2006.01) |
| *G05G 1/08* | (2006.01) |

(52) U.S. Cl.

CPC ..... *G05G 5/05* (2013.01); *F24C 7/08* (2013.01); *G05G 1/08* (2013.01)

(58) Field of Classification Search

CPC .. G05G 1/08; G05G 1/10; G05G 5/03; G05G 5/04; G05G 5/05; F24C 7/08; H01H 3/08; H01H 19/14

See application file for complete search history.

(56) References Cited

U.S. PATENT DOCUMENTS

| | | | | |
|---|---|---|---|---|
| 2,656,178 A | | 10/1953 | Hughes, Jr. | |
| 2,954,707 A | | 10/1960 | Kalous | |
| 6,151,987 A | * | 11/2000 | Porter | G05G 1/10 16/422 |

(Continued)

FOREIGN PATENT DOCUMENTS

| | | | | |
|---|---|---|---|---|
| DE | 19536993 A1 | * | 4/1996 | G05G 5/04 |
| DE | 20 2011 103276 | | 1/2012 | |

(Continued)

OTHER PUBLICATIONS

Machine Translation of DE 19536993, obtained Jul. 7, 2019.*

*Primary Examiner* — Richard W Ridley
*Assistant Examiner* — Brian J McGovern
(74) *Attorney, Agent, or Firm* — Womble Bond Dickinson (US) LLP

(57) ABSTRACT

A self-centering mechanism for an appliance knob includes a shaft member defining a central axis, and a rotatable member engaged and rotatable with the shaft member about the central axis. The rotatable member defines a first arcuate slot opposed to a second arcuate slot. A first stationary pin extends through the first arcuate slot and a second stationary pin extends through the second arcuate slot. A centering member is pivotably engaged with the rotatable member about a pivot location, and is configured to contact the first and second stationary pins with the rotatable member disposed in a centered rotational position. A biasing member is configured to bias the centering member about the pivot location toward the shaft member and the first and second stationary pins to urge the rotatable member to the centered rotational position.

16 Claims, 5 Drawing Sheets

(56) References Cited

U.S. PATENT DOCUMENTS

| | | | | |
|---|---|---|---|---|
| 2007/0042303 | A1* | 2/2007 | Wakitani | G05G 9/047 431/153 |
| 2017/0351292 | A1* | 12/2017 | Stoufer | G05G 5/04 |
| 2018/0210484 | A1* | 7/2018 | Stoufer | G05G 9/00 |

FOREIGN PATENT DOCUMENTS

| | | |
|---|---|---|
| EP | 3 015 946 | 5/2016 |
| GB | 2 312 787 | 11/1997 |
| WO | WO 2013/144456 | 10/2013 |

* cited by examiner

SELF-CENTERING MECHANISM FOR AN APPLIANCE KNOB

BACKGROUND

Field of the Disclosure

Aspects of the disclosure relate to appliances and, more particularly, to a self-centering mechanism for an appliance knob.

Description of Related Art

Modern home appliances include appropriate components that provide for control and/or operation thereof. In recent years, advancements and continued developments in sensor technology, encoder technology, and/or processing technology have enabled the implementation of sophisticated control units and/or controllers for home appliances. Various operational components of a home appliance are controllable via a control unit and/or controller in response to various commands or user selections for controlling such components initiated through a control element such as, for example, an appliance knob.

Some home appliances include a plurality of control buttons and/or the like configured to provide for incremental changes in an appliance operation. For example, an oven includes a plus symbol button and a minus symbol button on a control panel to increase and decrease the temperature of the oven respectively. Additionally or alternatively, an oven includes the plus button and the minus button on a control panel to incrementally adjust a clock, a timer, and/or the like. Another appliance utilizes a plus button and a minus button to cycle through different appliance functions and/or includes a plurality of buttons to indicate each appliance function available for selection. Thus, it would be desirable to provide an appliance knob with a self-centering mechanism for an appliance control unit and/or controller that would provide improved usability, ergonomics, and user-friendliness when changing an appliance parameter (e.g., oven temperature, cook timer, etc.) and/or an appliance function (e.g., bake, convection bake, broil, etc.) Such a solution should also be capable of implementing a self-centering mechanism that provides controlling operations which are intuitive to the user.

SUMMARY

The above and other needs are met by aspects of the present disclosure which, in one embodiment, provides a self-centering mechanism for an appliance knob. The self-centering mechanism includes a shaft member defining a central axis and a rotatable member engaged and rotatable with the shaft member about the central axis, the rotatable member extending radially outward from the shaft member and defining a first arcuate slot opposed to a second arcuate slot about the central axis. A first stationary pin extends through the first arcuate slot and a second stationary pin extends through the second arcuate slot. A centering member is pivotably engaged with the rotatable member about a pivot location disposed radially outward on the rotatable member from the first arcuate slot, the centering member extending from the pivot location across the rotatable member to a distal end, the centering member further defining a notch configured to receive the shaft member therein and being configured to contact the first and second stationary pins with the rotatable member disposed in a centered rotational position. A biasing member is configured to normally and torsionally bias the centering member about the pivot location toward the shaft member and the first and second stationary pins to urge the rotatable member to the centered rotational position.

It will be appreciated that the above Summary is provided merely for purposes of summarizing some example embodiments so as to provide a basic understanding of some aspects of the disclosure. As such, it will be appreciated that the above described example embodiments are merely examples of some embodiments and should not be construed to narrow the scope or spirit of the disclosure in any way. It will be appreciated that the scope of the disclosure encompasses many potential embodiments, some of which will be further described below, in addition to those here summarized. Further, other feature, aspects, and advantages of the disclosure will be apparent from a reading of the following detailed description taken in conjunction with the accompanying drawings which illustrate, by way of example, the principles of the described embodiments.

BRIEF DESCRIPTION OF THE DRAWINGS

In order to assist the understanding of aspects of the disclosure, reference will now be made to the appended drawings, which are not necessarily drawn to scale and in which like reference numerals refer to like elements. The drawings are exemplary only, and should not be construed as limiting the disclosure.

DETAILED DESCRIPTION

The present disclosure will now be described more fully hereinafter with reference to exemplary aspects thereof. These exemplary aspects are described so that this disclosure will be thorough and complete, and will fully convey the scope of the disclosure to those skilled in the art. Indeed, the disclosure may be expressed in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

It should be understood that although the terms first, second, etc. may be used herein to describe various steps or calculations, these steps or calculations should not be limited by these terms. These terms are only used to distinguish one operation or calculation from another. For example, a first calculation may be termed a second calculation, and, similarly, a second step may be termed a first step, without departing from the scope of this disclosure. As used herein, the term "and/or" and the "/" symbol includes any and all combinations of one or more of the associated listed items.

Figure 1:
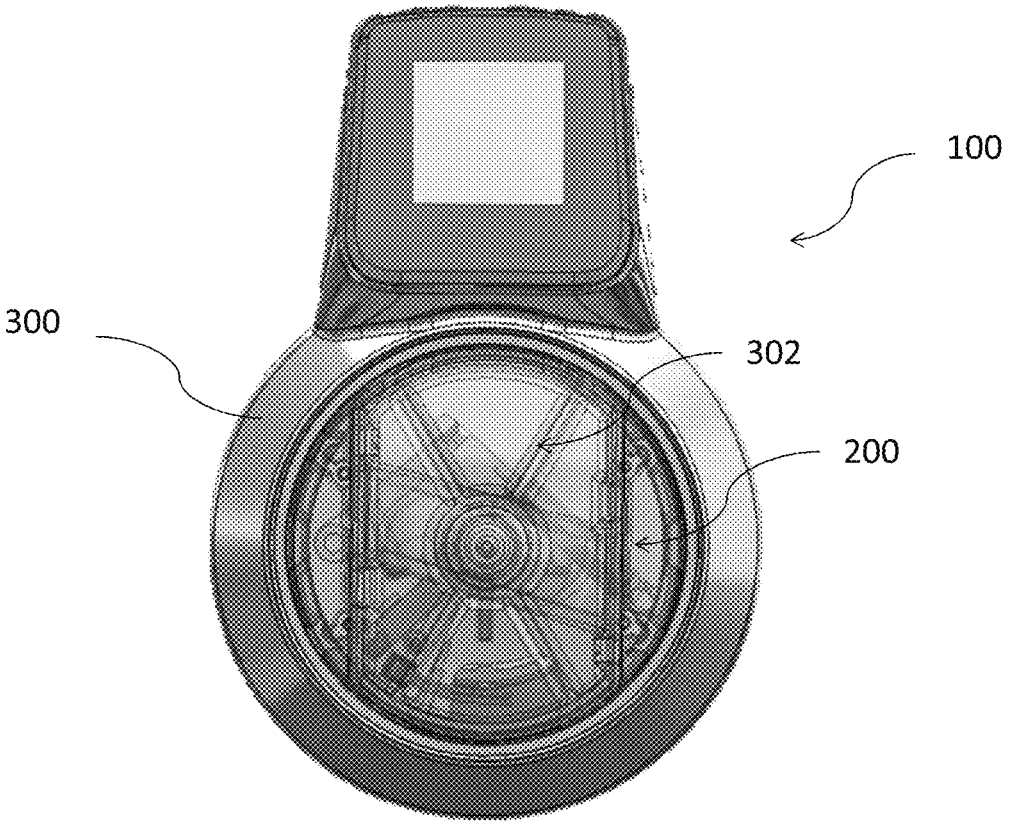
FIG. 1 illustrates an appliance knob including a self-centering mechanism according to one example aspect of the present disclosure.

As shown in FIG. 1, an appliance knob 100 that includes a self-centering mechanism 200 is provided. The appliance knob 100 is an appliance knob for any conventional household or commercial appliance such as, for example, an oven, a washing machine, a stove top, etc., that incrementally adjusts appliance functionality such as temperature, cycles, a clock, a timer, and/or the like.

Figure 2:
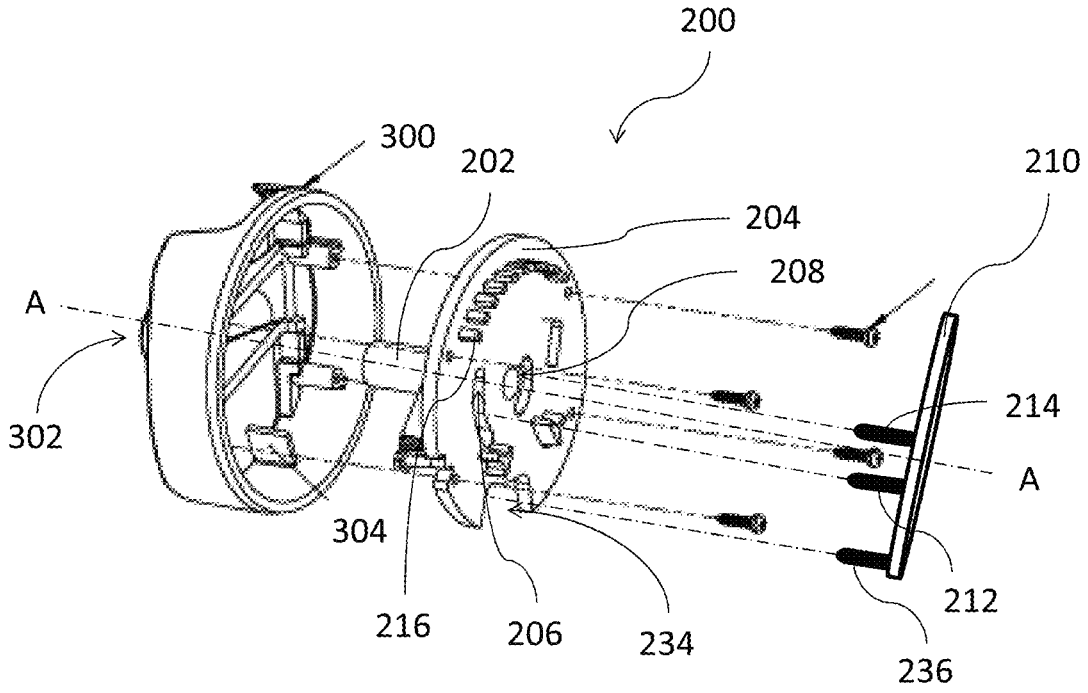
FIG. 2 illustrates an exploded view of a self-centering mechanism for an appliance knob according to one example aspect of the present disclosure.

The self-centering mechanism 200 is shown in greater detail in FIG. 2. As illustrated therein, the self-centering mechanism 200 includes a shaft member 202 defining a central axis A-A. In some aspects, a rotatable member 204 is engaged and rotatable with the shaft member 202 about the central axis A-A. The rotatable member 204 extends radially outward from the shaft member 202 and defines a first arcuate slot 206 opposed to a second arcuate slot 208 about the central axis A-A. For example, in one aspect, the rotatable member 204 and the shaft member 202 are integrally formed (see, e.g., FIG. 3), while in other aspects, the rotatable member 204 and the shaft member 202 are separately formed and engaged via heat, pressure, friction, etc.

Figure 3:
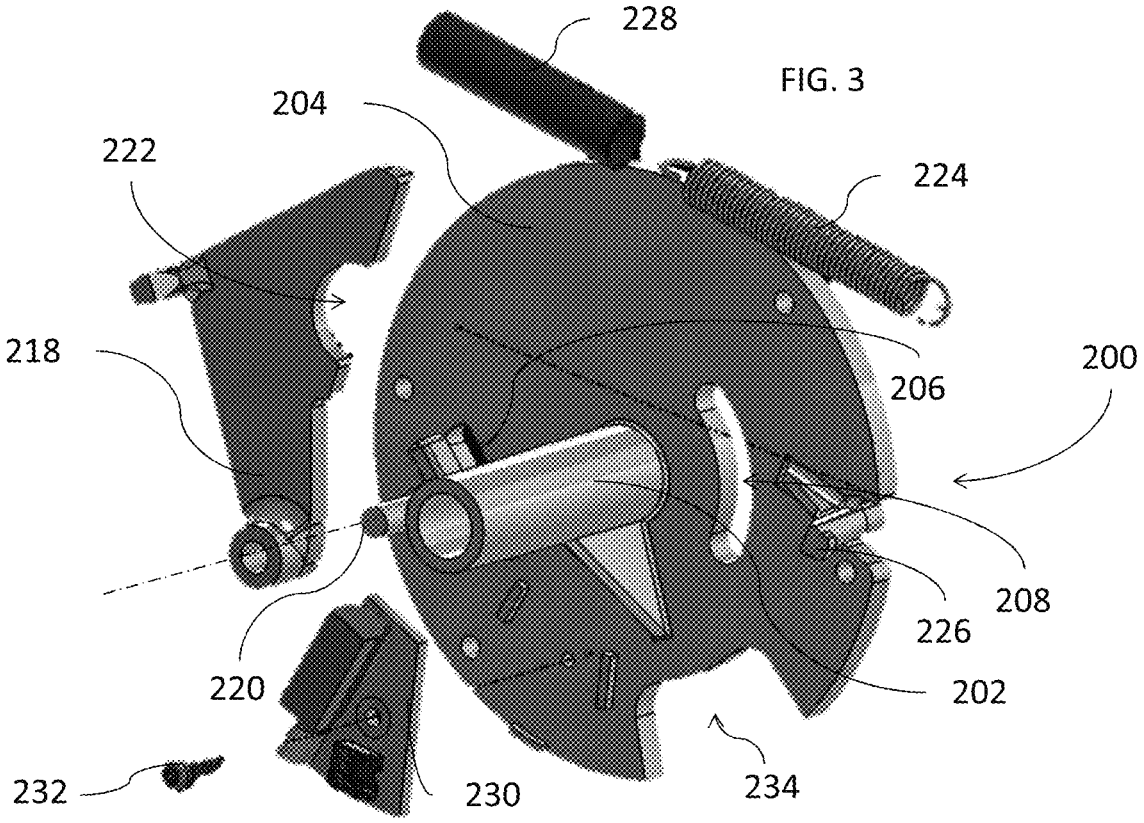
FIG. 3 illustrates an exploded view of a rotatable member, a centering member, a biasing member, and a haptic device of a self-centering mechanism for an appliance knob according to one example aspect of the present disclosure.
Figure 4A:
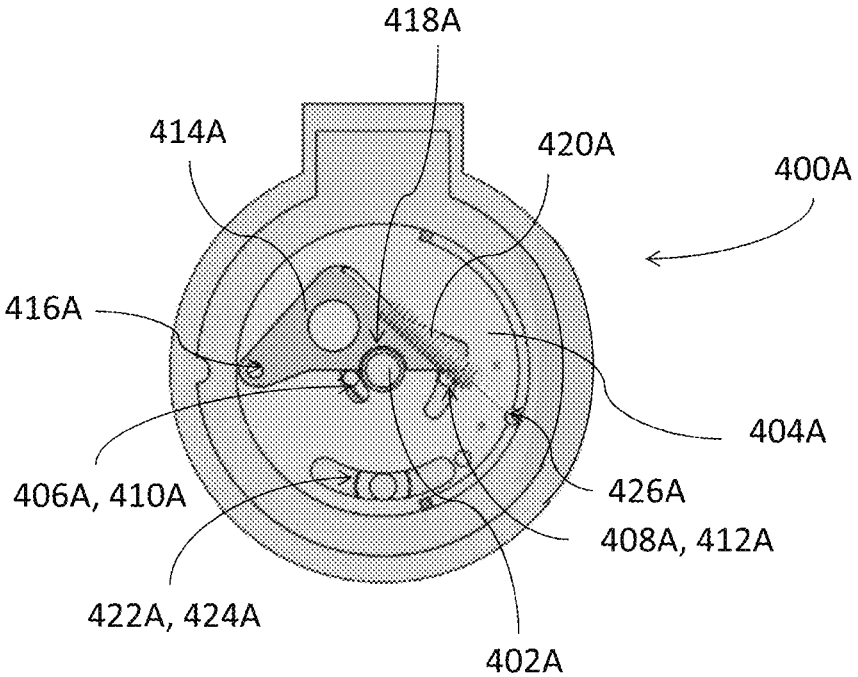
FIG. 4A illustrates a cross-sectional view of a self-centering mechanism having a rotatable member in a centered rotational position according to one aspect of the present disclosure.
Figure 4B:
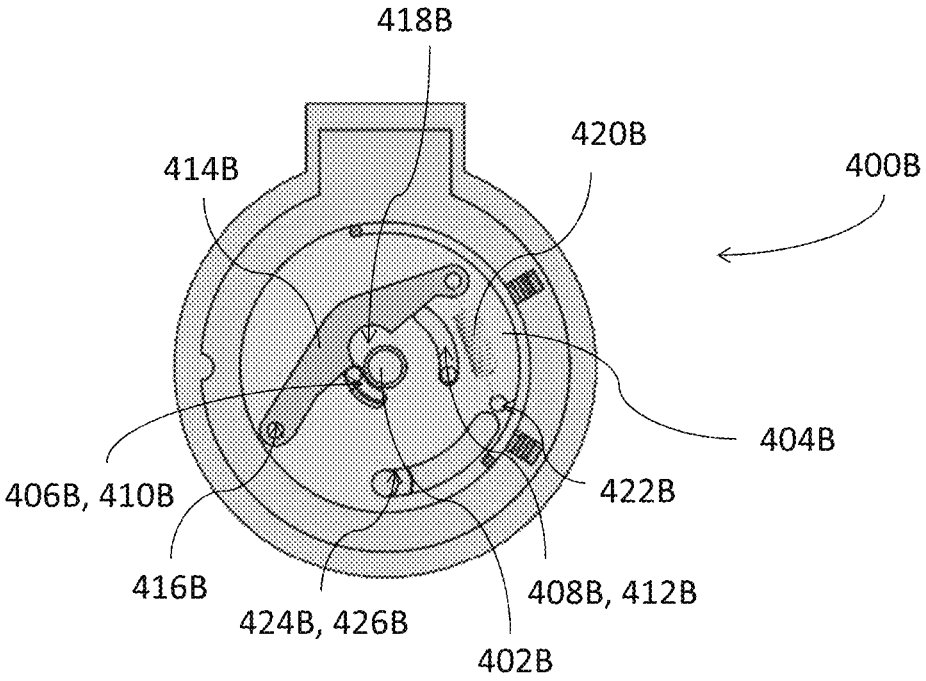
FIG. 4B illustrates a cross-sectional view of a self-centering mechanism having a rotatable member rotated to a maximum rotation in a first rotational direction from a centered rotational position according to one aspect of the present disclosure.

Notably, although FIGS. 1-3 illustrate the shaft member 202 being a hollow member extending through the respective center of the rotatable member 204, in some aspects, the shaft member 204 is shaped as a solid cylindrical member, as shown in FIGS. 4A-4B. In some other aspects, the shaft member 202 formed as a cylinder defines a radius that is less than a radius of the rotatable member 204 defining a circular shape. Alternatively, the shaft member 202 and the rotatable member 204 define a variety of shapes having, for example, nonlinear peripheral surfaces.

In some aspects, the first arcuate slot 206 and the second arcuate slot 208 are configured to each receive a pin therethrough. More particularly, for example, a support member 210 comprises a first stationary pin 212 and a second stationary pin 214 that extend from a planar surface of the support member 210 through the first arcuate slot 206 and the second arcuate slot 208, respectively. The first and/or second stationary pin 212, 214 are, for example, securely affixed, attached to, and/or integrally formed with the support member 210. The support member 210 is disposed adjacent to a first surface of the rotatable member 204 opposite a second surface of the rotatable member 204. The shaft member 202 extends through the rotatable member 204 perpendicularly to the first and second surfaces thereof. One or more spacers 216 (e.g., pegs, pins, etc.) are disposed on the first surface of the rotatable member 204 in order to maintain the support member 210 in spaced apart relation relative to the rotatable member 204. In some aspects, the support member 210, and, thus, the stationary pins 212, 214, are stationary and remain fixed in position on the support member 210, with respect to any rotational movement by the rotatable member 204.

The first and second arcuate slots 206, 208 defined by the rotatable member 204 each have an arc length. Accordingly, in some aspects, see, e.g., FIG. 4A, the first and second stationary pins 212, 214 respectively extend through the first and second arcuate slots 206, 208, about a midpoint of the respective arc lengths thereof, when the rotatable member 204 is disposed in a centered rotational position. In further aspects, the first or second arcuate slot 206, 208 defined by the rotatable member 204 is configured so as to limit rotation of the rotatable member 204 upon the first or second stationary pin 212, 214 engaging either end of the respective arcuate slot 206, 208. For example, the first or second arcuate slots 206, 208 are limited by a definitive arc length thereof. In this manner and in some aspects, the arc lengths of each of the first or second arcuate slots 206, 208 allow the rotatable member to rotate up to about 30 degrees in opposite rotational directions from the centered rotational position.

In some aspects, the self-centering mechanism 200 further comprises a centering member 218. Referring now to FIG. 3, a proximal end of the centering member 218 is, for example, pivotably engaged with the rotatable member 204 about a pivot location 220, wherein the pivot location 220 is disposed radially outward on the rotatable member 204 from the first arcuate slot 206. In this instance, the centering member 218 extends from the pivot location 220 and across the rotatable member 204 to a distal end. Accordingly, as illustrated in FIG. 3, in one aspect, the centering member 218 is a rocker arm formed of a resin or resin-like material that pivots about the pivot location 220 and extends from the pivot location 220 to the distal end.

In some aspects, the centering member 218 further defines a notch 222 configured to receive the shaft member 202 therein and configured to contact the first and second stationary pins 212, 214 with the rotatable member 204 disposed in a centered rotational position (see, e.g., FIG. 4A). As used herein, the "centered rotational position" is defined as a position that the centering member 218 returns to upon release of a knob member (e.g., 300) by a user, as described in greater detail herein, such that the centering member 218 exhibits no angular displacement relative to the lack of an applied load (i.e., no torque applied to the knob member).

In other such aspects, illustrated in FIG. 3, a biasing member 224 is provided with the self-centering mechanism 200. For example, the biasing member 224 is configured to normally and torsionally bias the centering member 218 about the pivot location 220 toward the shaft member 202 and the first and second stationary pins 212, 214. In this manner, the biasing member 224 cooperates with the first and second stationary pins 212, 214 to urge the rotatable member 204 to the centered rotational position. The biasing member 224 is, in some aspects, a coil spring extending between the distal end of the centering member 218 and an anchor member 226 (see, e.g., FIG. 4B). In other aspects, the biasing member 224 is a coil spring extending between a medial point defined between the proximal end and the distal end of the centering member 218 to the anchor member 226 (see, e.g., FIG. 4A) or is a torsional spring engaged between the centering member 218 and a pin associated with the pivot location 220. Other formations, arrangements, and/or dispositions of the biasing member 224 are also contemplated.

FIG. 3 further illustrates a sleeve damping member 228 configured to receive the biasing member 224 therein. The sleeve damping member 228 comprises, in some aspects, a flexible material configured to limit vibrations from the rotation of the rotatable member 204. In some aspects, the sleeve damping member 228 is formed of an elastomeric material configured to receive a coil spring therein.

In further aspects, the self-centering mechanism 200 comprises a haptic device 230 engaged with the rotatable member 204 and configured to provide tactile feedback associated with movement of the rotatable member 204. For example, and as illustrated in FIG. 3, the haptic device 230 comprises a printed circuit board including a haptic sensor to sense a load exerted by a user (i.e., torque applied to the appliance knob). The printed circuit board further includes, in these instances, a microprocessor (MCU) that is configured to receive and process the sensory output from the haptic sensor and direct an actuator to provide tactile feedback (e.g., vibration, audible tone, etc.) in response thereto. The haptic device 230 is, in some aspects, fastened to the surface of the rotatable member 204 via a fastener (e.g., a screw) 232.

Returning back to FIG. 2, in some aspects, the rotatable member 204 further defines a third arcuate slot 234. In one aspect, the third arcuate 234 slot is disposed radially outward of the shaft member 202 at an equal radial dimension to the pivot location 220. In these aspects, the third arcuate slot 234 has a first end toward the pivot location 220 and a second end distal to the pivot location 220, e.g., towards the anchor member 226. For example, as illustrated in FIGS. 1-3, the rotatable member 204 defines the third arcuate slot 234 as being disposed radially outward toward a circumferential edge of the rotatable member 204. In other examples, as illustrated in FIGS. 4A-4B, the rotatable member defines the third arcuate slot as curving in correspondence with the circumferential edge of the rotatable member. In still further examples, the third arcuate slot comprises any other shape, size, or location on the rotatable member.

In some aspects, the anchor member 226 is disposed opposite the third arcuate slot 234 from the pivot location 220, the anchor member 226 being disposed radially outward of the shaft member 202 at an equal radial dimension to the pivot location 220. In other aspects, the anchor member 226 is disposed independently of the third arcuate slot 234 in a manner that enables the biasing member 224 to normally and torsionally bias the centering member 218 about the pivot location 220 toward the shaft member 202 and the first and second stationary pins 212, 214 to urge the rotatable member 204 to the centered rotational position.

In some aspects, the third arcuate slot 234 has a third stationary pin 236 extending therethrough. For example, the third stationary pin 236 extends from the support member 210, as with the first and second stationary pins 212, 214, and the third stationary pin 236 extends through the third arcuate slot 234. Like the first and second stationary pins 212, 214, the third stationary pin 236 is stationary on the support member 210, with respect to any rotation of the rotatable member 204. The third stationary pin 236 is, for example, securely affixed, attached to, and/or integrally formed with the support member 210. In this manner, the third stationary pin 236 disposed about the midpoint of the third arcuate slot 234 when the rotatable member 204 is disposed in the centered rotational position (see, e.g., FIG. 4A).

Still referring to FIG. 2, in some aspects, the self-centering mechanism 200 comprises a knob member 300 fixedly engaged with the rotatable member 204 and configured to rotate the rotatable member 204 from the centered rotational position upon rotation thereof about the central axis A-A. For example, the knob member 300 is in press-fit or snap-fit engagement with the shaft member 202 and/or the rotatable member 204, such that rotation of the knob member 300 simultaneously rotates the shaft member 202 and the rotatable member 204. Additionally, engagement between the rotatable member 204 and the knob member 300 is, in some aspects, facilitated by one or more fasteners extending through the rotatable member 204 into bores defined in the knob member 300. Such fasteners include, for example, M2×8 mm screws.

To provide for user interaction therewith, the knob member 300 comprises a gripping portion 302, as illustrated in FIG. 1. The gripping portion 302 is configured to be ergonomically formed for easy grasping and manipulation by a user to rotate the knob member 300, and thereby the rotatable member 204 engaged therewith, from the centered rotational position.

The knob member 300 comprises, in some aspects, a damping device 304 engaged with each of the first and second ends of the third arcuate slot 234. Although in FIG. 2 only one damping device 304 is illustrated, the disclosure contemplates two such damping devices in spaced apart relation. Each of the damping devices 304 is configured to engage the third stationary pin 236 at maximum rotation of the rotatable member 204 in either rotational direction so as to damp contact forces between the third stationary pin 236 and each of the first and second ends of the third arcuate slot 234. The damping devices 304 are comprised of, for example, viscoelastic damping materials such as shape-memory alloys, ferromagnetic alloys, thermoplastics, rubbers, and the like.

Now referring to FIGS. 4A-4B, two exemplary embodiments of a self-centering mechanism for an appliance knob are illustrated, the self-centering mechanism comprising components similar to those described above in reference to FIGS. 1-3. FIG. 4A illustrates a first exemplary embodiment of a self-centering mechanism 400A in a centered rotational position, while FIG. 4B illustrates a second exemplary embodiment of a self-centering mechanism 400B in a maximum rotation in a first rotational direction. Notably, a maximum rotation in a second rotational direction is an inverse of the second exemplary embodiment of the self-centering mechanism 400B in FIG. 4B in the maximum rotation in the first rotational direction.

The self-centering mechanism 400A comprises, in some aspects, a shaft member 402A defining a central axis, a rotatable member 404A engaged and rotatable with the shaft member 402A about the central axis. The rotatable member 404A extends radially outward from the shaft member 402A and defines a first arcuate slot 406A opposed to a second arcuate slot 408A about the central axis. A first stationary pin 410A extends through the first arcuate slot 406A and a second stationary pin 412A extends through the second arcuate slot 408A. A centering member 414A is pivotably engaged with the rotatable member 404A about a pivot location 416A disposed radially outward on the rotatable member 404A from the first arcuate slot 406A, and the centering member 414A extends from the pivot location 416A across the rotatable member 404A to a distal end.

In some aspects, and as shown in FIG. 4A, when the self-centering mechanism 400A is in the centered rotational position, the centering member 414A defines a notch 418A that receives the shaft member 402A therein and contacts the first and second stationary pins 410A, 412A. To urge the rotatable member 404A to the centered rotational position, the self-centering mechanism 400A comprises a biasing member 420A configured to normally and torsionally bias the centering member 414A about the pivot location 416A toward the shaft member 402A and the first and second stationary pins 410A, 412A. Since the centering member 414A is formed, for example, as a rocker arm in FIG. 4A, the biasing member 420A, in some aspects, extends between a medial point of the centering member 414A, defined between the proximal end and the distal end of the centering member 414A, to an anchor member 426A. In this manner, when the rotatable member 404A is urged to the centered rotational position, the first stationary pin 410A, the second stationary pin 412A, and a third stationary pin 422A extending through a third arcuate slot 424A defined by the rotatable member 404A, are each disposed about a midpoint of an arc length of a respective arcuate slot defined by the rotatable member 404A.

Accordingly, in the centered rotational position illustrated in FIG. 4A, there is insufficient loading (e.g., biasing torque) applied to the appliance knob (e.g., the knob member) to rotate the rotatable member 404A from the centered rotational position. For example, in some aspects, an insufficient biasing torque comprises a torque of between about −63 and about 67 Newton millimeters (N-mm). The biasing torque comprises a magnitude and a directional component from rotating the appliance knob from the centered rotational position. More particularly, rotating the appliance knob (e.g., rotatable member 404A, 404B) from the centered rotational position in a first rotational direction or counter-clockwise results in a biasing torque having a negative directional component. Conversely, rotating the appliance knob (e.g., rotatable member 404A, 404B) from the centered rotational position in a second rotational direction or clockwise results in a biasing torque having a positive directional component. In this manner, a biasing torque applied to the appliance knob (and thus the rotatable member 404A, 404B) more than −63 N-mm or more than 67 N-mm (e.g., or more than −75 N-mm, more than 75 N-mm, etc.) is sufficient to rotate the appliance knob either in the first rotational direction (counter-clockwise) or a second rotational direction (clockwise).

Referring now to FIG. 4B, the second exemplary embodiment of the self-centering mechanism 400B is illustrated. The self-centering mechanism 400B comprises, in some aspects, a shaft member 402B defining a central axis, and a rotatable member 404B engaged and rotatable with the shaft member 402B about the central axis. The rotatable member 404B extends radially outward from the shaft member 402B and defines a first arcuate slot 406B opposed to a second arcuate slot 408B about the central axis. A first stationary pin 410B extends through the first arcuate slot 406B and a second stationary pin 412B extends through the second arcuate slot 408B. A centering member 414B is pivotably engaged with the rotatable member 404B about a pivot location 416B disposed radially outward on the rotatable member 404B from the first arcuate slot 406B, wherein the centering member 414B extends from the pivot location 416B across the rotatable member 404B to a distal end.

In particular, as shown in FIG. 4B, when the self-centering mechanism 400B is rotated to a maximum rotation in the first rotational direction, the first stationary pin 410B extending through the first arcuate slot 406B forms a first fulcrum with respect to the centering member 414B, urging the centering member 414B to pivot about the pivot location 416B in opposition to the torsional biasing of a biasing member 420B. In this manner, a notch 418B defined by the centering member 414B is removed from engagement with the shaft member 402B, and the rotatable member 404B is allowed or is otherwise free to be rotated to a maximum rotation in the first rotational direction. In one instance, the biasing member 420B is configured to be in a maximum elongated state when the rotatable member 404B is rotated to the maximum rotation in the first rotational direction.

Notably, in one aspect of the self-centering mechanism 400B illustrated in FIG. 4B, the centering member 414B is a rocker arm, and the biasing member 420B extends between a distal end of the centering member 414B and an anchor member 422B.

The first stationary pin 410B, the second stationary pin 412B, and a third stationary pin 424B extending through a third arcuate slot 426B defined in the rotatable member 404B, in some instances, are each disposed about a midpoint of an arc length of a respective arcuate slot defined by the rotatable member 404B. In this manner, for example, where the rotatable member 404B is rotated to the maximum rotation in the first rotational direction, the rotatable member is limited from further rotation by the first stationary pin 410B disposed about a first end of the first arcuate slot 406B and the second stationary pin 412B disposed about a second end (opposite of a first end) of the second arcuate slot 408B. Similarly, in this example, the rotatable member 404B is limited from further rotation by the third stationary pin 424B disposed about a first end of the third arcuate slot 426B, the first end of the third arcuate slot being disposed proximate to the pivot location 416B. As a result, in this instance, the rotatable member 404B has an angular displacement of about −30 degrees (e.g., 30 degrees counterclockwise) from a centered rotational position.

Conversely, the second arcuate slot 408B is radially spaced apart from the shaft member 402B such that, upon rotating the rotatable member 404B (e.g., applying a torque to the knob member) in a second rotational direction, opposite to the first rotational direction, the second stationary pin 412B extending through the second arcuate slot 408B forms a second fulcrum with respect to the centering member 414B. The centering member 414B is thus urged to pivot about the pivot location 416B in opposition to the torsional biasing of the biasing member 420B, so as to remove the notch 418B from engagement with the shaft member 402B. The rotatable member 404B is thus allowed or is otherwise free to be rotated to a maximum rotation in the second rotational direction. In this manner, the biasing member 420B is configured to be in a maximum elongated state when the rotatable member 404B is rotated to the maximum rotation in the second rotational direction.

At the maximum rotation in the second rotational direction, the first stationary pin 410B, the second stationary pin 412B, and the third stationary pin 424B are each disposed about a maximum point of an arc length of a respective arcuate slot, opposite the maximum point at which the pins are disposed when the rotatable member is rotated to the maximum rotation in the first rotational direction. In this manner, for example, where the rotatable member 404B is rotated to the maximum rotation in the second rotational direction, the rotatable member 404B is limited from further rotation by the first stationary pin 410B interacting with a second end (opposing the first end) of the first arcuate slot 406B, and the second stationary pin 412B interacting with the first end of the second arcuate slot 408B. Similarly, in this example, the rotatable member 404B is limited from further rotation by the third stationary pin 424B interacting with a second end of the third arcuate slot 426B, the second end of the third arcuate slot being disposed proximate to the anchor member 422B. As a result, in this instance, the rotatable member has an angular displacement of about 30 degrees (e.g., 30 degrees clockwise) from a centered rotational position.

In some aspects, the loading profile of the biasing member 420B in regard to travel of the distal end of the centering member 414B with respect to the anchor member 422B upon rotation of the rotatable member 404B (in degrees) is linear. As such, in some examples, the maximum rotation of the rotatable member 404B of about −30 degrees counter-clockwise from the centered rotational position in the first rotational direction results from a torque of about −80 N-mm applied thereto. In other examples, the maximum rotation of the rotatable member 404B of about 30 degrees clockwise from the centered rotational position in the second rotational direction results from a torque of about 76 N-mm applied thereto. Varying the magnitude of the torque applied to the rotatable member, in some aspects, varies the angular displacement of the rotatable member 404B. In other aspects, the loading profile of the biasing member 420B is logarithmic, exponential, etc.

Regardless of whether the rotatable member 404B is rotated to a maximum rotation in the first rotational direction or the second rotational direction, upon release of the rotatable member 404B, the biasing member 420B is configured to pivot the centering member 414B about the pivot location 416B toward the shaft member 402B. The interaction of the biasing member 420B with the centering member 414B thereby urges the centering member 414B to leverage the first fulcrum or the second fulcrum formed by the first stationary pin 410B or the second stationary pin 412B, respectively, and to rotate the rotatable member 404B back to the centered rotational position (see, e.g., FIG. 4A). In this manner, the biasing member 420B is configured to be in an equilibrium state (i.e., neither compressed nor extended) when the rotatable member 404B is in the centered rotational position.

Many modifications and other embodiments of the inventions set forth herein will come to mind to one skilled in the art to which these disclosed embodiments pertain having the benefit of the teachings presented in the foregoing descriptions and the associated drawings. Therefore, it is to be understood that embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

What is claimed is:

1. A self-centering mechanism for an appliance knob, the self-centering mechanism comprising:

a shaft member defining a central axis;

a rotatable member engaged and rotatable with the shaft member about the central axis, the rotatable member extending radially outward from the shaft member and defining a first arcuate slot opposed to a second arcuate slot about the central axis;

a first stationary pin extending through the first arcuate slot and a second stationary pin extending through the second arcuate slot;

a centering member pivotably engaged with the rotatable member about a pivot location disposed radially outward on the rotatable member from the first arcuate slot, the centering member extending from the pivot location across the rotatable member to a distal end, the centering member further defining a notch configured to receive the shaft member therein and being configured to contact the first and second stationary pins with the rotatable member disposed in a centered rotational position; and a biasing member configured to torsionally bias the centering member about the pivot location toward the shaft member and the first and second stationary pins to urge the rotatable member to the centered rotational position.

2. The mechanism of claim 1, comprising a knob member fixedly engaged with the rotatable member and configured to rotate the rotatable member from the centered rotational position upon rotation thereof about the central axis.

3. The mechanism of claim 2, comprising a haptic device engaged with the rotatable member and configured to provide tactile feedback associated with movement of the rotatable member through the knob member.

4. The mechanism of claim 1, wherein the first arcuate slot is radially spaced apart from the shaft member such that, upon rotating the rotatable member in a first rotational direction, the first stationary pin extending through the first arcuate slot forms a first fulcrum with respect to the centering member, urging the centering member to pivot about the pivot location in opposition to the torsional biasing of the biasing member, so as to remove the notch from engagement with the shaft member and allow the rotatable member to be rotated to a maximum rotation in the first rotational direction.

5. The mechanism of claim 4, wherein, upon release of the rotatable member, the biasing member is configured to pivot the centering member about the pivot location toward the shaft member, thereby urging the centering member to leverage the first fulcrum formed by the first stationary pin and rotate the rotatable member back to the centered rotational position.

6. The mechanism of claim 4, wherein the second arcuate slot is radially spaced apart from the shaft member such that, upon rotating the rotatable member in a second rotational direction, opposite to the first rotational direction, the second stationary pin extending through the second arcuate slot forms a second fulcrum with respect to the centering member, urging the centering member to pivot about the pivot location in opposition to the torsional biasing of the biasing member, so as to remove the notch from engagement with the shaft member and allow the rotatable member to be rotated to a maximum rotation in the second rotational direction.

7. The mechanism of claim 6, wherein, upon release of the rotatable member, the biasing member is configured to pivot the centering member about the pivot location toward the shaft member, thereby urging the centering member to leverage the second fulcrum formed by the second stationary pin and rotating the rotatable member back to the centered rotational position.

8. The mechanism of claim 1, wherein the first arcuate slot has an arc length and the second arcuate slot has an arc length, and wherein the first stationary pin extends through a midpoint of the arc length of the first arcuate slot and the second stationary pin extends through a midpoint of the arc length of the second arcuate slot when the rotatable member is disposed in the centered rotational position.

9. The mechanism of claim 8, wherein the first or second arcuate slot defined by the rotatable member is configured to limit rotation of the rotatable member upon the first or second stationary pin engaging either end of the first or second arcuate slot.

10. The mechanism of claim 1, wherein the first and second arcuate slots defined by the rotatable member are configured such that an arc length of the first arcuate slot and an arcuate length of the second arcuate slot allow the rotatable member to rotate up to 30 degrees in opposite rotational directions from the centered rotational position.

11. The mechanism of claim 1, wherein the rotatable member further defines a third arcuate slot having a third stationary pin extending therethrough, the third arcuate slot being disposed radially outward of the shaft member at an equal radial dimension to the pivot location, the third arcuate slot having a first end toward the pivot location and a second end distal to the pivot location, the third stationary pin extending through a midpoint of the third arcuate slot when the rotatable member is disposed in the centered rotational position.

12. The mechanism of claim 11, wherein the rotatable member comprises an anchor member disposed opposite the third arcuate slot from the pivot location, the anchor member being disposed radially outward of the shaft member at an equal radial dimension to the pivot location.

13. The mechanism of claim 12, wherein the biasing member comprises a coil spring extending between the distal end of the centering member and the anchor member.

14. The mechanism of claim 11, comprising a damping device engaged with the first end and the second end of the third arcuate slot, the damping device being configured to engage the third stationary pin at maximum rotation of the rotatable member in a first or a second rotational direction so as to damp contact forces between the third stationary pin and each of the first and second ends of the third arcuate slot.

15. The mechanism of claim 14, wherein the biasing member is configured to have a linear loading profile in relation to travel of the distal end of the centering member with respect to the anchor member upon rotation of the rotatable member.

16. The mechanism of claim 1, comprising a support member configured to be stationary with respect to the rotatable member, the first stationary pin extending from the support member and through the first arcuate slot and the second stationary pin extending from the support member and through the second arcuate slot.

* * * * *